US009481923B2

(12) United States Patent
Choi et al.

(10) Patent No.: US 9,481,923 B2
(45) Date of Patent: Nov. 1, 2016

(54) METHODS FOR BOTH COATING A SUBSTRATE WITH ALUMINUM OXIDE AND INFUSING THE SUBSTRATE WITH ELEMENTAL ALUMINUM

(75) Inventors: Jung-Pyung Choi, Richland, WA (US); Kenneth Scott Weil, Richland, WA (US)

(73) Assignee: Battelle Memorial Institute, Richland, WA (US)

( * ) Notice: Subject to any disclaimer, the term of this patent is extended or adjusted under 35 U.S.C. 154(b) by 1092 days.

(21) Appl. No.: 12/469,888

(22) Filed: May 21, 2009

(65) Prior Publication Data

US 2010/0297341 A1 Nov. 25, 2010

(51) Int. Cl.

| | |
|---|---|
| ***C23C 10/18*** | (2006.01) |
| ***C23C 10/30*** | (2006.01) |
| ***C23C 10/60*** | (2006.01) |

(52) U.S. Cl.

CPC ..... *C23C 10/18* (2013.01); *C23C 10/30* (2013.01); *C23C 10/60* (2013.01)

(58) Field of Classification Search

USPC ..... 427/226

See application file for complete search history.

(56) References Cited

U.S. PATENT DOCUMENTS

| | | | | |
|---|---|---|---|---|
| 4,228,203 | A * | 10/1980 | Yagi et al. | 148/512 |
| 4,729,912 | A * | 3/1988 | Kilbane et al. | 427/376.8 |
| 5,399,438 | A * | 3/1995 | Tateishi et al. | 428/548 |
| 7,056,555 | B2 | 6/2006 | Bauer et al. | |
| 2002/0094445 | A1 | 7/2002 | Sangeeta et al. | |
| 2004/0180232 | A1 * | 9/2004 | Das et al. | 428/610 |
| 2007/0023142 | A1 * | 2/2007 | LaGraff et al. | 156/345.31 |
| 2007/0298166 | A1 * | 12/2007 | Kool et al. | 427/230 |
| 2008/0081214 | A1 * | 4/2008 | Narita et al. | 428/665 |

OTHER PUBLICATIONS

Tian, Xiaodong, et al., "Structure of Al-modified silicide coatings on an Nb-based ultrahigh temperature allow prepared by pack cementation techniques", Surface & Coatings Technology, 2009, 1161-1166 pps., vol. 203, Elsevier, China.

Frangini, S., et al., "Intermetallic FeA1 based coatings deposited by the electrospark technique: corrosion behavior in molten (Li+K) carbonate", Science Direct, Surface Coatings & Technology, 2004, 31-39 pps., vol. 184, Elsevier, Rome, Italy.

(Continued)

*Primary Examiner* — Robert Vetere

(74) *Attorney, Agent, or Firm* — Wells St. John P.S.

(57) ABSTRACT

Methods of aluminizing the surface of a metal substrate. The methods of the present invention do not require establishment of a vacuum or a reducing atmosphere, as is typically necessary. Accordingly, aluminization can occur in the presence of oxygen, which greatly simplifies and reduces processing costs by allowing deposition of the aluminum coating to be performed, for example, in air. Embodiments of the present invention can be characterized by applying a slurry that includes a binder and powder granules containing aluminum to the metal substrate surface. Then, in a combined step, a portion of the aluminum is diffused into the substrate and a portion of the aluminum is oxidized by heating the slurry to a temperature greater than the melting point of the aluminum in an oxygen-containing atmosphere.

14 Claims, 2 Drawing Sheets

(56) References Cited

OTHER PUBLICATIONS

Zhu, Xiao-Lin, et al., "Microstructure and corrosion resistance of Fe-A1 intermetallic coating on 45 steel synthesized by double glow plasma surface alloying technology", Science Direct, Transactions of Nonferrous Metals Society of China, 2009, 143-148 pps., vol. 19, Elsevier, China.

Bianco, Robert, et al., "Codepositing Elements by Halide-Activated Pack Cementation", The Journal of the Minerals, Metals & Materials Society, Nov. 1991, 20-25 pps., vol. 43, No. 11, USA.

* cited by examiner

METHODS FOR BOTH COATING A SUBSTRATE WITH ALUMINUM OXIDE AND INFUSING THE SUBSTRATE WITH ELEMENTAL ALUMINUM

STATEMENT REGARDING FEDERALLY SPONSORED RESEARCH OR DEVELOPMENT

This invention was made with Government support under Contract DE-AC0576RL01830 awarded by the U.S. Department of Energy. The Government has certain rights in the invention.

BACKGROUND

Metals and alloys, especially those employed in high temperature applications, are often susceptible to reaction (e.g., oxidation, corrosion, diffusion by other species, volatilization of constituent species, etc.) with surrounding and/or nearby chemical species. These reactions can negatively impact the chemical properties, the mechanical properties, and/or the performance of the metals and alloys with respect to their particular application. One way to address the problem is to coat the surface of the metals or alloys with a protective material. Many of the processes for applying such coatings require carefully controlled atmospheres and/or special equipment, which can be expensive and inconvenient to establish and maintain. Accordingly, a need exists for improved methods of applying protective coatings to metal and/or alloy substrates.

SUMMARY

The present invention includes methods of aluminizing the surface of a metal substrate without the need to establish a vacuum or reducing atmosphere, as is typically necessary. Accordingly, aluminization can occur in the presence of oxygen, which greatly simplifies and reduces processing costs by allowing deposition of the aluminum coating to be performed, for example, in air. Embodiments of the methods described herein result in easily applied, high quality, aluminum oxide coatings that are strongly bound to the metal or alloy substrate and provide a protective surface.

According to one embodiment, the method of aluminizing the surface of a metal substrate is characterized by applying a slurry that comprises a binder and powder granules comprising aluminum to the metal substrate surface. Then, in a combined step, a portion of the aluminum is diffused into the substrate and a portion of the aluminum is oxidized by heating the slurry to a temperature greater than the melting point of the aluminum in an oxygen-containing atmosphere. Typically, the slurry is heated to a temperature greater than or equal to 660° C. Rarely should the temperature exceed 1200° C. Preferably the temperature is between 800° C. and 1100° C.

The metal substrate can comprise an iron-based alloy. Preferably, the iron-based alloy is one that comprises chromium. Alternatively, the metal circuitry can comprise a nickel-based alloy or a cobalt-based alloy.

In some embodiments, the powder granules have an average diameter within the range of 10 nm to 1000 μm. Preferably, the powder granules have an average diameter within the range of 0.1 μm to 45 μm. The size of the powder granules can significantly influence the structure of the aluminum coating. For example, in some embodiments the portion of oxidized aluminum is increased relative to the portion of aluminum that diffuses into the substrate by decreasing the powder granule average diameter. Similarly, the portion of oxidized aluminum can be decreased relative to the portion of aluminum that diffuses into the sub straight by increasing the powder granule average diameter.

In a preferred embodiment, the methods described herein are operated as continuous processes on a plurality of metal substrates. Exemplary metal substrates include, but are not limited to, those that will be employed in high temperature applications, such as in solid oxide fuel cell stacks or in boiler devices.

The purpose of the foregoing abstract is to enable the United States Patent and Trademark Office and the public generally, especially the scientists, engineers, and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Various advantages and novel features of the present invention are described herein and will become further readily apparent to those skilled in this art from the following detailed description. In the preceding and following descriptions, the various embodiments, including the preferred embodiments, have been shown and described. Included herein is a description of the best mode contemplated for carrying out the invention. As will be realized, the invention is capable of modification in various respects without departing from the invention. Accordingly, the drawings and description of the preferred embodiments set forth hereafter are to be regarded as illustrative in nature, and not as restrictive.

DESCRIPTION OF DRAWINGS

Embodiments of the invention are described below with reference to the following accompanying drawings.

DETAILED DESCRIPTION

The following description includes the preferred best mode of one embodiment of the present invention. It will be clear from this description of the invention that the invention is not limited to these illustrated embodiments, but that the invention also includes a variety of modifications and embodiments thereto. Therefore the present description should be seen as illustrative and not limiting. While the invention is susceptible of various modifications and alternative constructions, it should be understood, that there is no intention to limit the invention to the specific form disclosed, but, on the contrary, the invention is to cover all modifications, alternative constructions, and equivalents falling within the spirit and scope of the invention as defined in the claims.

Figure 1:
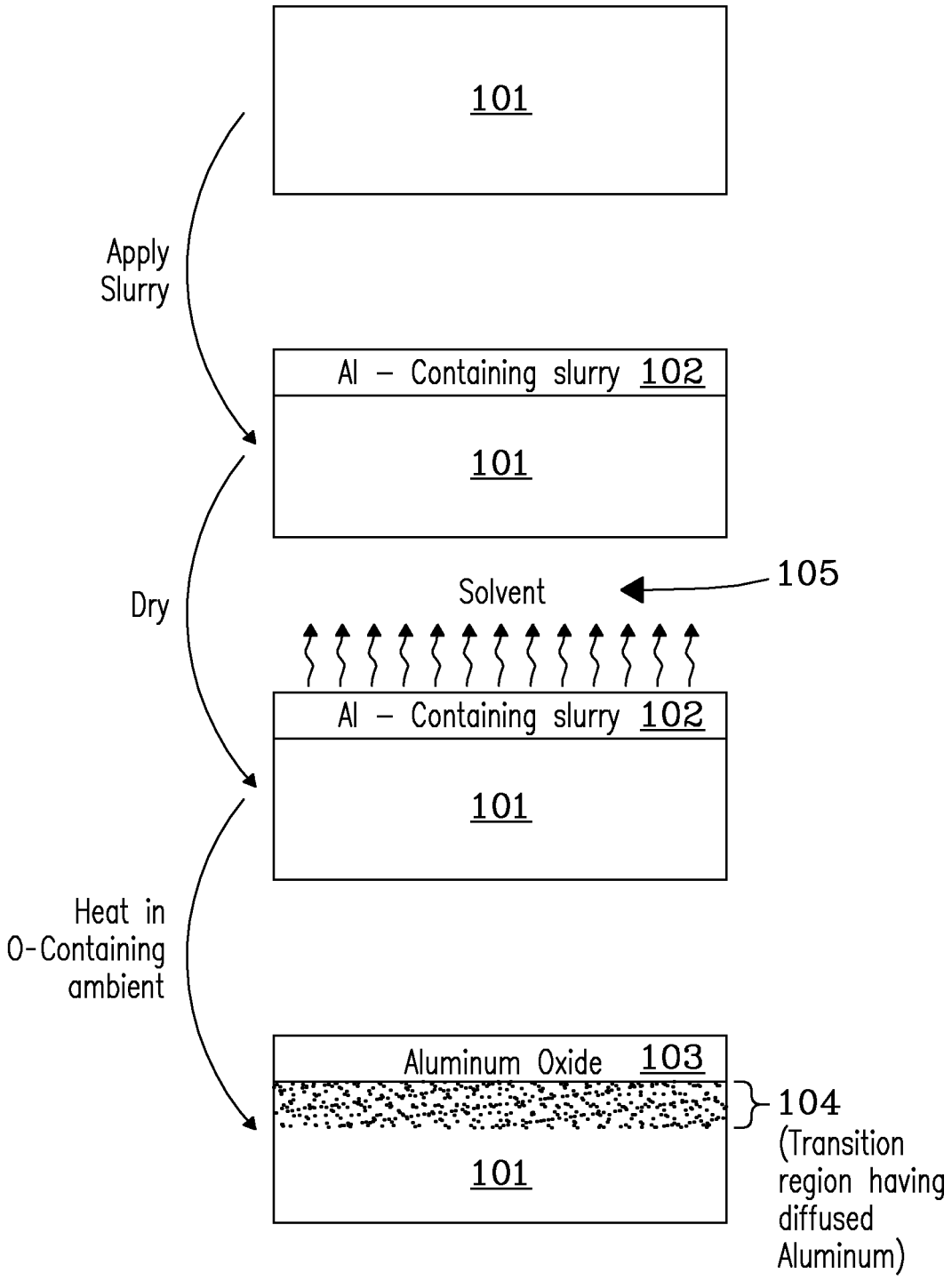
FIG. 1 is an illustration depicting the aluminization of a metal substrate surface according to one embodiment of the present invention.
Figure 2:
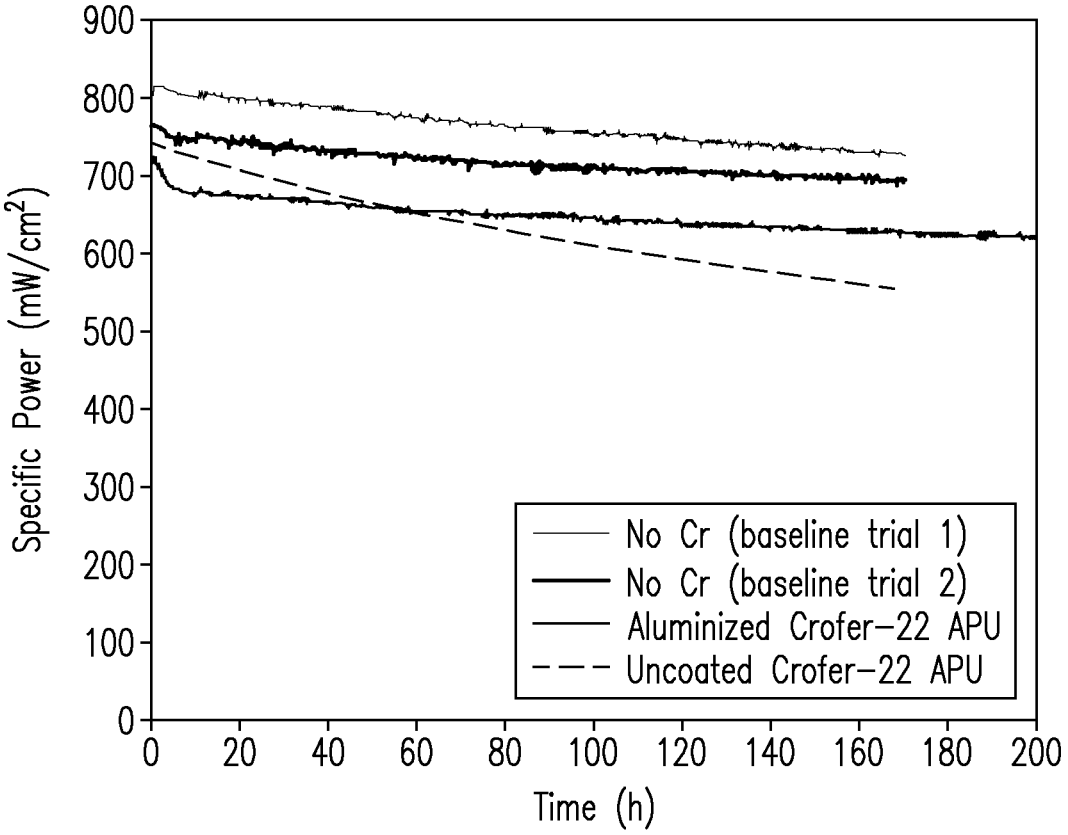
FIG. 2 is a plot showing button cell performance curves.

FIGS. 1 and 2 show a variety of aspects of the present invention. Referring first to FIG. 1, the illustration depicts the aluminization of a metal substrate (e.g., Cr-containing iron alloy) according to one embodiment of the present invention. While the present invention is not limited to Al coatings on Cr-containing alloys, many aspects of the invention are demonstrated well by this material system because of the particular relevance of Cr-containing alloys to high-temperature applications and because of the processing difficulties of Cr-containing alloys. For example, the list of candidate high-temperature alloys considered applicable in SOFCs generally is limited to those that form a stable, protective chromium oxide scale in-situ during use. However chromia is susceptible to volatilization at high temperature (>600° C.), particularly in water vapor bearing environments, due to the formation of gaseous $CrO_3$ and $CrO_2(OH)_2$. Furthermore, it has been established that these species will preferentially adsorb onto oxygen catalysis sites at the cathode/electrolyte interfaces within the cells, which causes continual degradation in the overall power output of the fuel cell system. While the use of complex conductive oxide coatings (such as chromium manganite spinel) is a useful means of mitigating chromia volatility in interconnect components, they are not necessarily applicable to other in-stack and balance-of-plant components, all of which can have a potential role in the formation of deleterious Cr-gas species. In these cases, aluminum-based coatings may afford greater functionality (i.e. a combination of low-cost application, long-term oxidation resistance, minimal chromia volatility, and improved seal durability).

According to the instant embodiment, aluminization comprises applying a relatively low viscosity Al powder/polymer binder slurry 102 onto the surfaces of the metal substrate 101, drying the coated component in air at 80° C. to drive off the slurry solvent 105, and heating in air at temperatures above ~660° C. to initiate diffusion 104 of the aluminum into the underlying substrate and begin forming a protective alumina scale 103 in a combined step.

In a particular example, a Cr-containing Fe alloy coupon was employed (e.g., 73.7% Fe, 24% Cr, 0.8% Mn, 0.5% Si, 0.5% Cu, and 0.5% Al). Coupons measuring 10 mm×25.4 mm were machined from these plates, then ultrasonically cleaned in isopropanol and rinsed with acetone prior to coating. As listed in Table 1, three different nominal sizes of aluminum powder were evaluated (all high purity aluminum—the actual purities are listed). In addition, two soak temperatures and four binder systems were examined. Because the nominal particle size of the powder can define the minimum applied slurry coating thickness, this factor was investigated as a function of powder particle size.

TABLE 1

Variables tested and compared in the aluminzation of Cr-containing Fe alloys

| Soak Temperature/Time | Binder Type | Al Powder Particle Size |
|---|---|---|
| 700° C., 4 h | None | 0.1 μm (purity: 97.5%) |
| 1000° C., 1 h | Isopropanol | 3 μm (purity: 97.5%) |
| | Heraeus V-006 | 44 μm (purity: 99.5%) |
| | ESL 450 | |

The aluminum slurry pastes were prepared by mixing aluminum powder with a given binder in a ratio of 70:30 by weight, first by hand and then by using a three-roll mill to achieve uniform dispersion. Substrate coupons were coated using a stencil printing technique and dried in a convection oven at 80° C. for a minimum of 2 h. The coupons were then heated in an air muffle furnace at 3° C./min to the final soak conditions and cooled at 3° C./min. Loose debris on the surface of the coated materials was removed with a nylon brush. We have since employed a light fluidized sand attrition process that yields similar results with minimal labor.

A 700° C., 4 h heat treatment in air was conducted on coupons having a 200 μm thick layer of a slurry comprising 44 μm Al powder and various binders (e.g., isopropanol, organic binders HERAEUS V-006 and ESL 450). This low-temperature treatment resulted in acceptable coatings, but ones that demonstrated relatively poor adhesion and that would likely exhibit poor chromia retention behavior due to only partial coverage of the underlying chromia-scale forming substrate. Based on these findings, subsequent heat treatments were conducted at a more preferred temperature, 1000° C. for 1 h.

With respect to appropriate binder selection, three separate slurries were prepared, each containing 44 μm Al powder suspended in either: isopropanol, HEREAUS V-006, or ESL 450, which are organic binders. Results from coating experiments conducted with these slurries were compared with a baseline case in which no binder was used, but the coupons were coated with loose aluminum powder (44 μm size). In all cases, the coated coupons were heat treated in air at 1000° C. for 1 h. It was found that only slurries prepared with the Heraeus binder resulted in well-adhered coatings displaying uniform surface coverage. Both the loose power and isopropanol slurry coatings yielded virtually no aluminization phenomenon. The ESL-based slurries resulted in coatings with better surface coverage than either loose powder or isopropanol slurries, but still a relatively patchy appearance; one in which chromia formation and subsequent volatilization could still foreseeably take place. The success of the HEREAUS binder is due to organic constituents in the binder that carburize and/or volatilize at temperatures near or above the melting point of aluminum, thereby delaying excessive oxidation in the powder particles and allowing greater melting and diffusion of aluminum into the substrate to take place.

The average size of the aluminum powder can play a significant role in the structure of the final coating, including surface roughness and morphology and the extent of aluminum diffusion into the substrate (i.e. depth of the Al diffusion zone). These factors in turn lead to changes in the thermal expansion properties of the substrate, which affect the likelihood of oxide scale spallation and general coating durability under thermal cycling conditions. Fundamentally, powder particle size can determine the balance between competing oxidation and diffusion mechanisms that occur during the air heat treatment step. Surface oxidation consumes aluminum within each particle, forming an $Al_2O_3$ scale layer. In general, the larger the powder particle size, the lower the surface area available for particle oxidation to take place and therefore the greater the amount of aluminum available to diffuse into the substrate. Conversely at very small powder particle sizes, a larger fraction of the aluminum will be consumed via oxidation during heat treatment in air, leaving less molten aluminum to react with and/or diffuse into the substrate alloy. That is: $rate_{oxid} \alpha 4\pi r^2$ and $rate_{diff} \alpha 1.333\pi r^3$, assuming the powder is approximately spherical with an average radius of r. While uniform $Al_2O_3$ coatings can be formed from aluminum powders with a wide range of sizes, the relatively larger particle sizes afford a measurable Al diffusion zone. This diffusion zone represents a store of aluminum that can be "tapped" during stack operation so that a protective alumina scale inherently reforms if it becomes damaged, for example during thermal cycling.

The Cr-containing Fe alloy of the above example was aluminized using 44 μm, 3 μm, and 0.1 μm size aluminum powder. Referring to Table 2, the extent of aluminum diffusion decreases as the powder size decreases. Below the 0.1 μm powder size there essentially was no diffusion zone, just a thin alumina scale layer. It appears that a minimum particle size exists at which aluminum diffusion does not take place because a sufficiently strong oxide shell forms on each particle, which encases the molten aluminum within. Above a threshold particle size, the volumetric ratio of oxide and metal is such that the molten aluminum will break through this shell due to high stresses associated with volumetric expansion during melting. Accordingly, in some embodiments, the average powder granule diameter is between 10 nm and 1000 μm. In preferred embodiments, the diameter is between 0.1 μm and 45 μm.

TABLE 2

Surface roughness and scale and diffusion zone thickness data

| Measurement | Average Al Particle Powder Size | | |
|---|---|---|---|
| | 44 μm | 3 μm | 0.1 μm |
| Target coating thickness | 160* | 160 | 160 |
| Average surface roughness | 50 | 6 | <1 |
| Scale thickness | 0.5 | 0.5 | >100 |
| Diffusion zone thickness | 120 | 105 | ~0 |

*All values are reported in microns.
**Much of the scale is lost due to spallation.

Referring to Table 2, powder particle size can also affect the morphology of the final coated surface. The larger particle size tends to lead to higher values of surface roughness, with little roughness being observed for the 0.1 μm powder coatings. However, it should be noted that regardless of the degree of surface roughness, the top scale appears to be nearly pure aluminum oxide.

Energy-dispersive X-ray (EDX) data from these surfaces as well as from a region ~10 μm deep (i.e., the diffusion zone) into an aluminized sample and a bare coupon heated in air are provided in Table 3. The scale formed on the uncoated Cr-containing Fe alloy coupon consists of a mixture of iron and chromium oxide, whereas that of the aluminized Cr-containing Fe alloy coupon contains very little iron or chromium. It should be noted that the error associated with these numbers is significant (as high as 10 wt %). Unless conducted using a glancing angle technique, EDX tends to collect compositional information not only from the thin surface scale but also from a region ~1-2 μm deep into the sample. That is, it is likely that scale formed on the aluminized material contains virtually no Fe or Cr and that formed on the uncoated sample is closer in composition to pure $Cr_2O_3$.

TABLE 3

Results from direct EDX analysis of the materials in FIGS. 3 (a) and (b).

| | | O | Fe | Cr | Al |
|---|---|---|---|---|---|
| Crofer | Aluminized surface | 15.02* | 4.26 | 1.53 | 79.19 |
| | Region ~10 μm deep into the sample aluminized sample | 0.67 | 43.62 | 12.79 | 42.92 |
| | Uncoated surface | 17.10 | 20.16 | 62.74 | 0.00 |
| | Alloy composition | 1.26 | 75.86 | 22.52 | 0.35 |

*All values are reported in wt %.

Results from a Cr poisoning test can provide another indication of scale composition and coating functionality. Shown in FIG. 2 is a set of button cell performance curves in which a potential source of Cr (either uncoated Cr-containing Fe alloy or Cr-containing Fe alloy aluminized on all exposed surfaces using the 44 μm Al powder) was placed in the humid air environment to which the cathode was exposed. Two baseline trials were made using no potential Cr source. As seen by the slopes of the curves, cells operated with aluminized Cr-containing Fe alloy coupons exhibit the same degree of intrinsic power degradation (due to microstructural changes in the cathode, anode, and electrolyte materials) as cells operated with components that contain no source of Cr or $Cr_2O_3$. By comparison, the incorporation of uncoated Cr-containing Fe alloy coupons leads to exaggerated power degradation (a steeper time-dependent power slope) due to the volatility of chromia. In summary, the aluminization coating appears to block the formation of volatile chromium species.

While a number of embodiments of the present invention have been shown and described, it will be apparent to those skilled in the art that many changes and modifications may be made without departing from the invention in its broader aspects. The appended claims, therefore, are intended to cover all such changes and modifications as they fall within the true spirit and scope of the invention.

We claim:

1. A method for both coating a substrate with aluminum oxide and infusing the substrate with elemental aluminum, the method comprising:

providing a substrate having a Cr-containing surface;

providing a metal powder/polymer binder slurry, the slurry comprising a solvent, an organic binder, and metal granules;

dispersing the slurry upon the Cr-containing surface;

after dispersing the slurry, exposing the slurry to air and maintaining the temperature of the slurry and substrate below 80° C. to remove at least a portion of the solvent from the slurry; and after removing at least a portion of the solvent from the slurry, in a combined step, both exposing the binder, metal granules and substrate to air and heating the remaining slurry and substrate to a temperature of from 1000° C. to 1200° C. to both diffuse the at least a portion of the metal of the metal granules into the substrate and coat the substrate with aluminum oxide.

2. The method of claim 1 wherein the substrate has a Cr—Fe-containing surface.

3. The method of claim 2 wherein the Cr—Fe-containing surface further comprises one or both of Co and/or Ni.

4. The method of claim 1 wherein the metal of the metal granules comprise aluminum.

5. The method of claim 4 the granules are from between 0.1 and 45 um in diameter.

6. The method of claim 1 wherein the metal powder/polymer binder slurry comprises organic constituents that carburize and/or volatilize at temperatures near or above the melting point of the metal.

7. The method of claim 1 wherein during the combined step at least a portion of the aluminum is oxidized.

8. The method of claim 1 wherein the metal of the metal granules comprise an aluminum alloy.

9. The method of claim 1 wherein the binder of the metal powder/polymer binder slurry is an organic based system having a final evaporation or decomposition temperature greater than 100° C.

10. The method of claim 9 wherein during the exposing the slurry to air and maintaining the temperature of the slurry and substrate below 80° C. the metal of the metal powder/polymer binder slurry remains unoxidized.

11. The method of claim 1 wherein the metal powder/polymer binder slurry comprises a ratio of binder to powder within the range of 10:1 to 1:10 by volume.

12. The method of claim 1 wherein the dispersing the slurry upon the Cr-containing surface comprises applying the slurry by spray dispensing, paste dispensing, painting, dip coating, stencil printing, or screen printing.

13. The method of claim 1 operating as a continuous process on a plurality of substrates.

14. The method of claim 1 wherein the metal substrate is a component of a solid oxide fuel cell stack or a boiler device.

* * * * *